US010858953B2

(12) United States Patent
Schmidt

(10) Patent No.: US 10,858,953 B2
(45) Date of Patent: Dec. 8, 2020

(54) TURBINE CASING HEAT SHIELD IN A GAS TURBINE ENGINE

(71) Applicant: Rolls-Royce Deutschland Ltd. & Co. KG, Blankenfelde-Mahlow (DE)

(72) Inventor: Marcel Schmidt, Berlin (DE)

(73) Assignee: ROLLS-ROYCE DEUTSCHLAND LTD & CO KG, Blankenfelde-Mahlow (DE)

( * ) Notice: Subject to any disclaimer, the term of this patent is extended or adjusted under 35 U.S.C. 154(b) by 236 days.

(21) Appl. No.: 15/957,266

(22) Filed: Apr. 19, 2018

(65) Prior Publication Data

US 2019/0071996 A1 Mar. 7, 2019

(30) Foreign Application Priority Data

Sep. 1, 2017 (IN) ..... 201711031065

(51) Int. Cl.

*F01D 11/00* (2006.01)
*F01D 25/14* (2006.01)
*F01D 25/24* (2006.01)

(52) U.S. Cl.

CPC ..... *F01D 25/145* (2013.01); *F01D 11/005* (2013.01); *F01D 25/246* (2013.01); *F05D 2240/15* (2013.01)

(58) Field of Classification Search

CPC ..... F01D 25/145; F01D 25/246; F01D 11/005
See application file for complete search history.

(56) References Cited

U.S. PATENT DOCUMENTS 2,915,280 A * 12/1959 Gerhard ..... F01D 11/001 415/138
3,730,640 A 5/1973 Rice et al.
5,201,846 A 4/1993 Sweeney
5,597,286 A * 1/1997 Dawson ..... F01D 9/065 415/115
5,987,879 A * 11/1999 Ono ..... F01D 9/023 60/800
6,076,835 A * 6/2000 Ress ..... F01D 11/005 277/637

(Continued)

FOREIGN PATENT DOCUMENTS

EP 3 095 958 A1 11/2016
FR 3 009 739 A1 2/2015

OTHER PUBLICATIONS

Extended European Search Report, issued in European Patent Application No. 18188164.0, dated Feb. 4, 2019, pp. 1-10, European Patent Office, Munich, DE.

*Primary Examiner* — Woody A Lee, Jr.
(74) *Attorney, Agent, or Firm* — Brinks Gilson & Lione

(57) ABSTRACT

Systems and methods for reducing heat exposure of a turbine casing in a gas turbine engine may be provided. The system may include a blade track coupled with a turbine casing with a clip. The system may further include a nozzle guide vane coupled to the turbine casing. A cavity may be formed by an end of the blade track, the clip, and a portion of the nozzle guide vane. A heat shield may be positioned between the clip and the end of the blade track in the cavity such that an edge of the heat shield and the portion of the nozzle guide vane form a gap. The heat shield and the nozzle guide vane may be positioned such that the gap closes in response to the heat shield and the nozzle guide vane thermally expanding.

18 Claims, 7 Drawing Sheets

(56) References Cited

U.S. PATENT DOCUMENTS

| | | | | |
|---|---|---|---|---|
| 6,347,508 | B1 * | 2/2002 | Smallwood | F01D 9/023 60/796 |
| 7,665,957 | B2 * | 2/2010 | Khanin | F01D 11/005 415/134 |
| 2006/0245924 | A1 * | 11/2006 | Audeon | F01D 11/005 415/214.1 |
| 2014/0003924 | A1 | 1/2014 | Bonneau et al. | |
| 2015/0322807 | A1 * | 11/2015 | Budnick | F01D 9/041 277/654 |
| 2017/0145846 | A1 * | 5/2017 | Albers | F01D 5/02 |

* cited by examiner

TURBINE CASING HEAT SHIELD IN A GAS TURBINE ENGINE

CROSS-REFERENCE TO RELATED APPLICATION

This application claims priority to Indian provisional patent application 201711031065 entitled "Turbine Casing Heat Shield in a Gas Turbine Engine," filed Sep. 1, 2017, the entire contents of which are hereby incorporated by reference.

TECHNICAL FIELD

This disclosure relates to gas turbine engines and, in particular, to heat shields.

BACKGROUND

In a gas turbine engine, a gap is typically left between a blade track and a nozzle guide vane. The gap allows the blade track and the nozzle guide vane to thermally expand during operation of the gas turbine engine without causing damage by the blade track and the nozzle guide vane coming into contact with each other.

BRIEF DESCRIPTION OF THE DRAWINGS

The embodiments may be better understood with reference to the following drawings and description. The components in the figures are not necessarily to scale. Moreover, in the figures, like-referenced numerals designate corresponding parts throughout the different views.

DETAILED DESCRIPTION

A gap that is typically left between a blade track and a nozzle guide vane in a gas turbine engine may be useful to decrease a risk that the blade track contacts the nozzle guide vane during operating of the gas turbine engine. However, heat from hot fluid flowing through blades that are located radially inward of the blade track may pass radially outward through the gap and reach the turbine case.

By way of an introductory example, a system for reducing heat exposure of a turbine casing in a gas turbine engine may be provided. The system may include a heat shield positioned between a clip and an end of a blade track, a gap defined by an edge of the heat shield and a nozzle guide vane, and a cavity defined by: the clip, the end of the blade track, and the nozzle guide vane. The clip may couple the blade track to the turbine casing. The nozzle guide vane may also be coupled to the turbine casing. The heat shield and the nozzle guide vane may be positioned such that the gap closes and a seal is formed in response to the heat shield and the nozzle guide vane thermally expanding during operation of the gas turbine engine.

One interesting feature of the systems and methods described below may be that the gap being sealed may reduce a temperature in the cavity during operation of the gas turbine engine compared to the temperature in the cavity if the gap were not sealed. Alternatively, or in addition, an interesting feature of the systems and methods described below may be that the reduced temperatures in the cavity may increase a lifespan of one or more components around the cavity, thus reducing replacement or maintenance costs. Alternatively or in addition, an interesting feature of the systems and methods described below may be that the materials typically used for relevant components may be replaced by less expensive alternative materials as a result of the components having reduced exposure to high temperatures.

Figure 1:
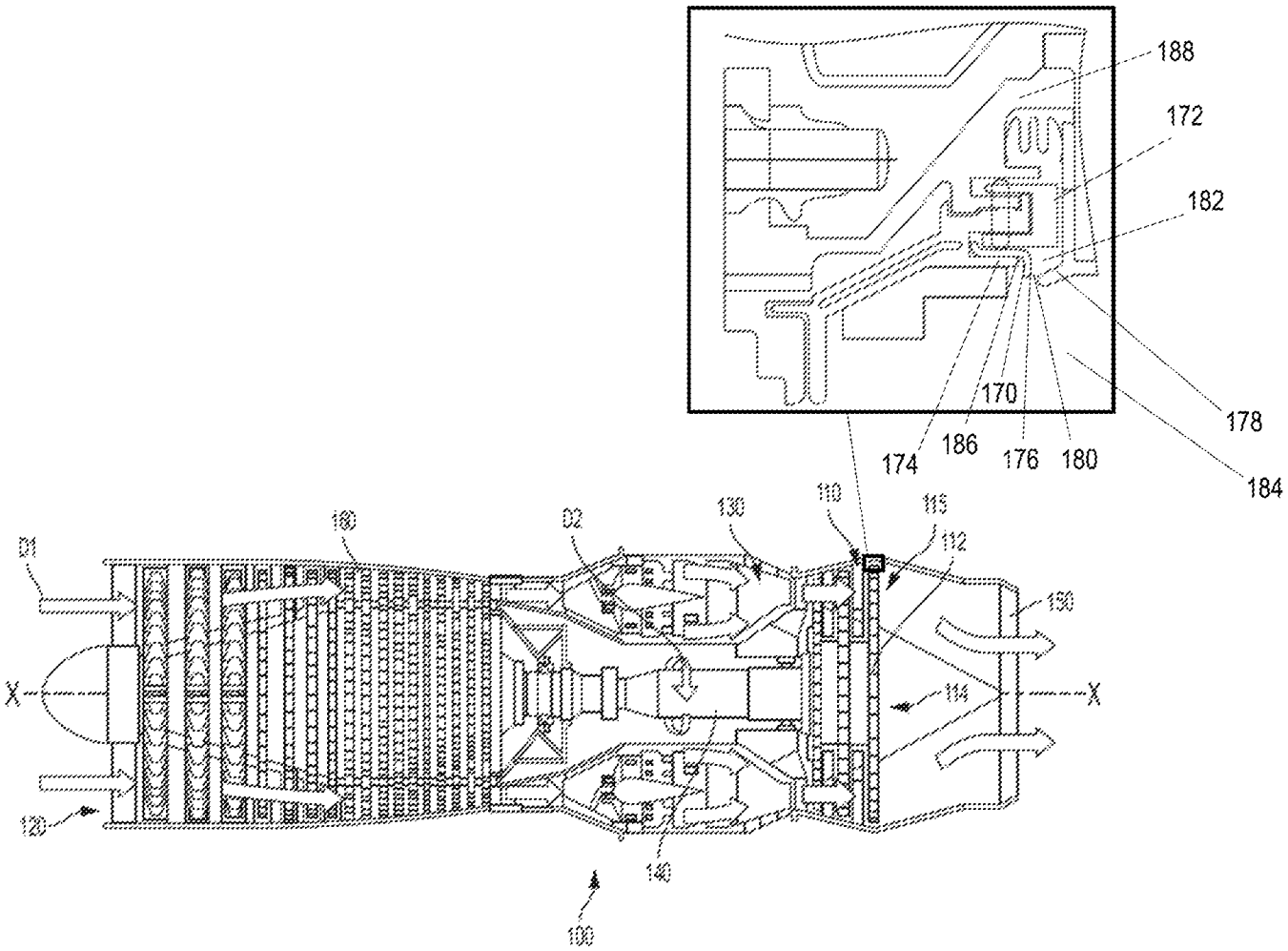
FIG. 1 illustrates a cross-sectional view of an example of a gas turbine engine with a close-up view of a cross section of portion of a turbine section of the gas turbine engine.

FIG. 1 illustrates a cross-sectional view of a gas turbine engine 100 and a close-up cross-sectional view of a portion of the gas turbine engine 100. The gas turbine engine 100 may be for propulsion of, for example, an aircraft. Alternatively or in addition, the gas turbine engine 100 may be used to drive a propeller in aquatic applications, or to drive a generator in energy applications. The gas turbine engine 100 may include an intake section 120, a compressor section 160, a combustion section 130, a turbine section 110, and an exhaust section 150. During operation of the gas turbine engine 100, fluid received from the intake section 120, such as air, travels along the axial direction D1 and may be compressed within the compressor section 160. The compressed fluid may then be mixed with fuel and the mixture may be burned in the combustion section 130. The axial direction D1 may be the direction of fluid flow during operation of the gas turbine engine 100. The combustion section 130 may include any suitable fuel injection and combustion mechanisms. The hot, high pressure fluid may then pass through the turbine section 110 to extract energy from the fluid and cause a turbine shaft of a turbine 114 in the turbine section 110 to rotate, which in turn drives the compressor section 160. Discharge fluid may exit the exhaust section 150.

As noted above, the hot, high pressure fluid may pass through the turbine section 110 during operation of the gas turbine engine 100. As the fluid flows through the turbine section 110, the fluid may pass through a blade assembly 115, specifically between adjacent blades 112 included in the blade assembly 115, coupled to the turbine 114 causing the turbine 114 to rotate. The rotating turbine 114 may turn a shaft 140 in a first rotational direction D2, for example. The blades 112 may rotate around an axis of rotation, which may correspond to a centerline X of the turbine 114 in some examples. The blade assembly 115 may include, for example, an arrangement of the blades 112 in the turbine section 110 of the gas turbine engine 100.

As the hot, high pressure fluid passes through the turbine section 110, heat from the fluid is transferred to components of the turbine section 110. Examples of components that receive heat from the hot, high pressure fluid may include a nozzle guide vane 178 and a heat shield 170.

The nozzle guide vane 178 may be a component of the turbine section 110 that directs the flow of the hot, high pressure fluid that passes through the turbine section 110 to, for example, a rotor. The nozzle guide vane 178 and an edge 176 of the heat shield 170 may define a gap 180. The nozzle guide vane 178 may be a component configured to operate in a nozzle guide vane cold state and, alternatively, in a nozzle guide vane hot state. The nozzle guide vane cold state may be the state of operation of the nozzle guide vane 178 in which the thermal expansion of the nozzle guide vane 178 is insufficient to result in the gap 180 being sealed. Alternatively or in addition, the nozzle guide vane 178 operating in the nozzle guide vane cold state may result in a fluid in a fluid flow channel 184 accessing a cavity 182 via the gap 180.

Alternatively, the nozzle guide vane hot state may be the state of operation of the nozzle guide vane 178 in which the thermal expansion of the nozzle guide vane 178 is sufficient to result in the gap 180 being sealed. Alternatively or in addition, the nozzle guide vane 178 operating in the nozzle guide vane hot state may result in the fluid in the turbine section 110 being inhibited from accessing the cavity 182 via the gap 180 for at least the reason that the gap 180 may be sealed.

The nozzle guide vane 178 may be coupled to a turbine casing 188, and be configured to thermally expand in response to receiving heat from a first heat source. Examples of the first heat source may be the fluid in the turbine section 110, a heating apparatus supplying heat to the nozzle guide vane 178 such as a combustor, heat generated from friction of moving parts in the gas turbine engine 100, or combinations thereof. For example, the hot fluid travelling through the turbine section 110 during operation of the gas turbine engine 100 may supply sufficient heat to the nozzle guide vane 178 resulting in the nozzle guide vane 178 thermally expanding to contact the edge 176 of the heat shield 170 resulting in the gap 180 being sealed. Alternatively or in addition, the nozzle guide vane 178 may be a component that may couple with the heat shield 170 as a result of a thermal expansion of the nozzle guide vane 178, a thermal expansion of the heat shield 170, or both. The nozzle guide vane 178 may include any material capable of thermally expanding to couple with the heat shield 170. Examples of suitable materials include nickel alloys such as Hastalloy X material, Rene41, any suitable nickel alloy, any material that may resist hot gas temperatures, or combinations thereof. In some examples, the nozzle guide vane 178 may include wear resistant material.

The heat shield 170 may be a component configured to operate in a heat shield cold state and, alternatively, in a heat shield hot state. The heat shield cold state may be the state of operation of the heat shield 170 in which the thermal expansion of the heat shield 170 is insufficient to result in the gap 180 being sealed. Alternatively or in addition, the heat shield 170 operating in the heat shield cold state may result in the fluid in the fluid flow channel 184 accessing the cavity 182 via the gap 180.

Alternatively, the heat shield hot state may be the state of operation of the heat shield 170 in which the thermal expansion of the heat shield 170 is sufficient to result in the gap 180 being sealed. Alternatively or in addition, the heat shield 170 operating in the heat shield hot state may result in the fluid in the turbine section 110 unable to access the cavity 182 via the gap 180 for at least the reason that the gap 180 may be sealed. The heat shield 170 may be a component configured to thermally expand in response to receiving heat from a second heat source. The second heat source may be the same or different from the first heat source described above. Examples of the second heat source may be the fluid in the turbine section 110, a heating apparatus supplying heat to the nozzle guide vane 178, heat generated from friction of moving parts in the gas turbine engine 100, or combinations thereof. For example, the hot fluid travelling through the turbine section 110 during operation of the gas turbine engine 100 may supply sufficient heat to the heat shield 170 resulting in the heat shield 170 thermally expanding and as a result, the edge 176 of the heat shield 170 may to contact the nozzle guide vane 178 and seal the gap 180. Alternatively or in addition, the heat shield 170 may be a component that may couple with a nozzle guide vane 178 as a result of the thermal expansion of the heat shield 170, the thermal expansion of the nozzle guide vane 178, or both. Alternatively or in addition, the heat shield 170 may be a component positioned between a clip 172 and an end 186 of a blade track 174. The heat shield 170 may include any material capable of thermally expanding to couple with the nozzle guide vane 178. Examples of suitable materials include nickel alloys such as Hastalloy X material, Rene41, any suitable nickel alloy, or combinations thereof.

The heat shield 170 and nozzle guide vane 178 may be present in any section of the gas turbine engine 100. For example, the heat shield 170 and the nozzle guide vane 178 may be present in the turbine section 110, as shown in FIG. 1. Alternatively or in addition, the heat shield 170 and the nozzle guide vane 178 may be present in the intake section 120, the combustion section 130, the exhaust section 150, the compressor section 160, or combinations thereof.

The gap 180 may be an opening between, for example, the edge 176 of the heat shield 170 and the nozzle guide vane 178. The gap 180 may include a distance between the heat shield 170 and the nozzle guide vane 178 such that the thermal expansion of the heat shield 170 and the nozzle guide vane 178 may result in the gap 180 being sealed or closed. Alternatively or in addition, the gap 180 may be an opening defined by, for example, the edge 176 of the heat shield 170 and the nozzle guide vane 178. Alternatively or in addition, the gap 180 may be a channel that facilitates mass transfer between the cavity 182 and the fluid flow channel 184. Alternatively or in addition, mass transfer between the cavity 182 and the fluid flow channel 184 may be suspended as a result of the gap 180 being sealed.

The blade track 174 may include a track that guides blades 112 as the blades 112 rotate within the turbine 114. The blade track 174 may include an indentation or recess that allows insertion of a tip of the blade 112. Thus inserted, the tip of the blade 112 may limit or block fluid in the fluid flow channel 184 from travelling over the tip of the blade 112. Alternatively or in addition, as a result of the blade tip inserted into the blade track 174, fluid in the fluid flow channel 184 may be directed to flow around a portion of the blade 112 that results in the blade 112 rotating around the turbine 114. Alternatively or in addition, the end 186 of the blade track 174 may partially define the cavity 182. Alternatively or in addition, the heat shield 170 may be positioned between the blade track 174 and the clip 172. Alternatively or in addition, the heat shield 170 may be positioned between the end 186 of the blade track 174 and the clip 172.

The fluid flow channel 184 may be a channel in which the hot, high pressure fluid flows during operation of the gas turbine engine 100. The fluid in the fluid flow channel 184 may be transferred into the cavity 182 as a result of the heat shield 170 operating in the heat shield cold state, the nozzle guide vane 178 operating in the nozzle guide vane cold state, or both. Alternatively or in addition, the fluid in the fluid flow channel 184 may be transferred into the cavity 182 as a result of the gap 180 having a non-zero width as a result of the edge 176 of the heat shield 170 contacting the nozzle guide vane 178. In some examples, the fluid in the fluid flow channel 184 may transfer sufficient heat to the heat shield 170 during operation of the gas turbine engine 100 such that the heat shield 170 operates in the heat shield hot state. Alternatively or in addition, the fluid in the fluid flow channel 184 may transfer sufficient heat to the nozzle guide vane 178 during operation of the gas turbine engine 100 such that the nozzle guide vane 178 operates in the nozzle guide vane hot state. Alternatively or in addition, the fluid in the fluid flow channel 184 may transfer sufficient heat to the heat shield 170 and/or the nozzle guide vane 178 such that the gap 180 is sealed. The fluid flow channel 184 may be located in the turbine section 110, the intake section 120, the combustion section 130, the exhaust section 150, the compressor section 160, or combinations thereof.

The cavity 182 may be a recess formed by the end 186 of the blade track 174, the clip 172, and the nozzle guide vane 178. Matter and/or heat in the fluid flow channel 184 may be transferred into the cavity 182 as a result of the gap 180 being open. Alternatively or in addition, matter and/or heat may be inhibited from transferring from the fluid flow channel 184 into the cavity 182 as a result of the gap 180 being sealed.

Figure 2:
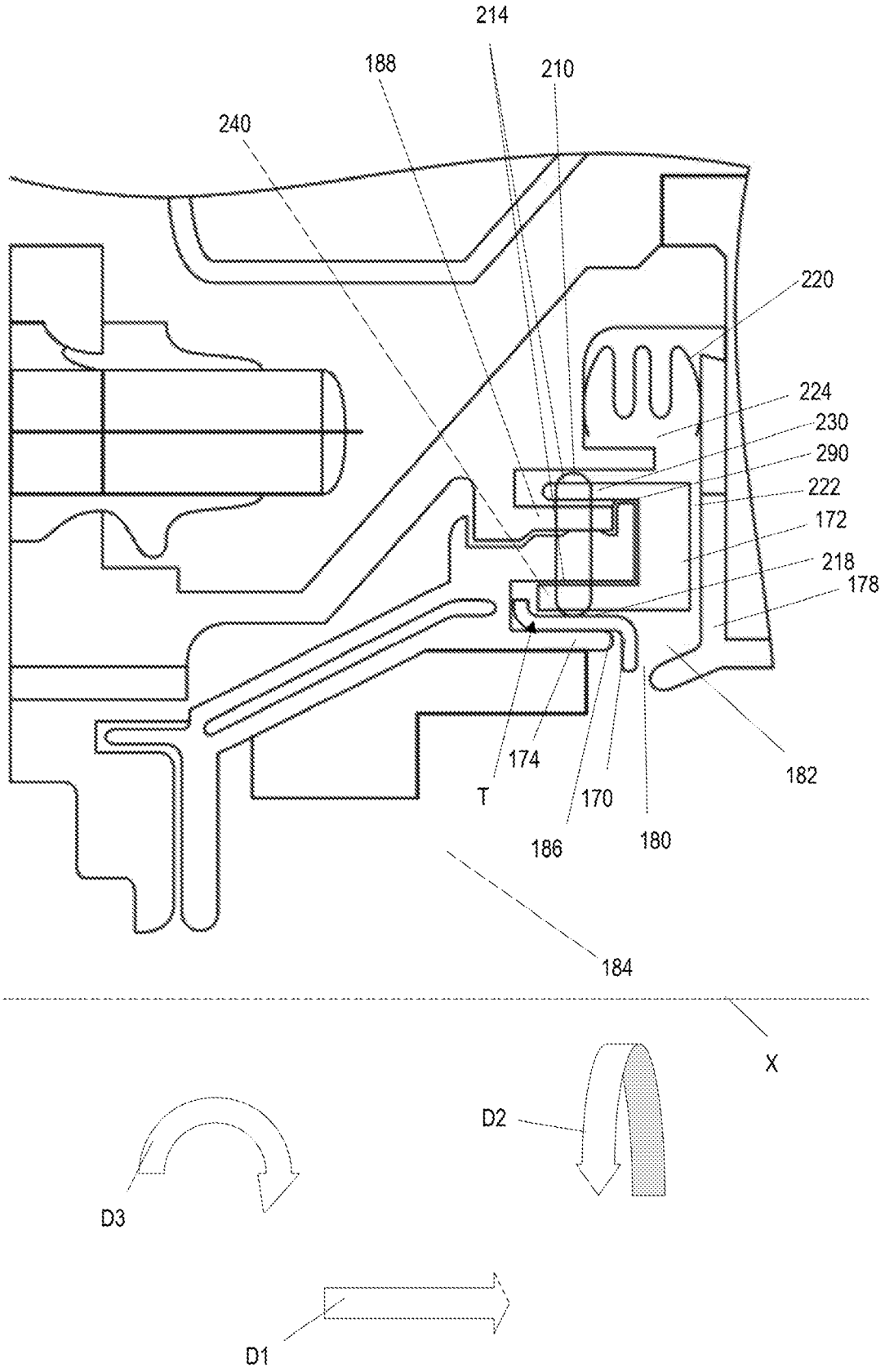
FIG. 2 illustrates the close-up view of the cross section of the portion of the turbine section of the gas turbine engine as shown in FIG. 1.

FIG. 2 shows the close-up cross sectional view of a portion of the gas turbine engine 100 as shown in FIG. 1 with more details labeled. FIG. 2 shows the heat shield 170 positioned between the clip 172 and the end 186 of the blade track 174. The clip 172 may be a component that assists in maintaining the heat shield 170 in place. The shape of the clip 172 may be any suitable shape such that the heat shield 170 may be positioned between the clip 172 and the end 186 of the blade track 174. In some examples, the clip 172 may have a C-shape, as shown in FIG. 1 and FIG. 2. In some examples, the clip 172 may be brazed or welded to the turbine casing 188. Alternatively or in addition, the clip 172 may include a hook 290 that may couple the clip 172 and the turbine casing 188. Alternatively or in addition, the clip 172 may inhibit the heat shield 170 from rotating in a second rotational direction D3. The clip 172 may be made from various materials. Examples of suitable materials include nickel alloys such as Hastalloy X material, Rene41, any suitable nickel alloy, or combinations thereof. Alternatively or in addition, the clip 172 may include a plurality of clip slots 214. The clip slots 214 may be slots in the clip 172 sized to receive an anti-rotation pin 210. In some examples, the clip 172 may have clip slots 214 located at a first clip end 230 and a second clip end 240 of the clip 172, as shown in FIG. 2. The clip slots 214 may be sized such that the anti-rotation pin 210 may penetrate the clip 172 at the first clip end 230 and emerge from the second clip end 240.

The second rotational direction D3 may be a rotational direction orthogonal to the first rotational direction D2. Additionally, the second rotational direction D3 may be a rotational direction parallel to the plane depicting the cross section of the portion of the gas turbine engine 100 shown in FIG. 2.

The hook 290 may be a component of the clip 172 that couples the clip 172 to the turbine casing 188. Alternatively or in addition, the hook 290 may be a claw or tooth of the clip 172 that may couple the clip 172 with the turbine casing 188. In some examples, the hook 290 may be brazed or welded to the turbine casing 188. In some examples, the hook 290 may be removeably attached to the turbine casing 188. In some examples, the clip 172 may be inhibited from moving as a result of the hook 290 coupled to the turbine casing 188.

FIG. 2 shows the anti-rotation pin 210 inserted in the first clip slot 230 and the second clip slot 240 as well as contacting the heat shield 170. The anti-rotation pin 210 may be a bar or shaft that may inhibit rotation of the heat shield 170 in the first rotational direction D2. As mentioned above, the first rotational direction D2 may be the direction of rotation of the blades 112 during operation of the gas turbine engine 100. In some examples, the anti-rotation pin 210 may be inserted into a heat shield slot 310 (shown in FIG. 3). Alternatively or in addition, the anti-rotation pin 210 may assert pressure onto a surface 218 of the heat shield 170. In some examples, the pressure asserted onto the surface 218 of the heat shield 170 by the anti-rotation pin 210 may inhibit the heat shield 170 from moving in any direction. Alternatively, in some examples, the pressure asserted onto the surface 218 of the heat shield 170 may inhibit rotation of the heat shield 170 in the first rotational direction D2. The heat shield slot 310 is explained in more detail below.

The heat shield 170 may include a side-view cross section T. The side-view cross section T may be a surface or shape that is or would be exposed by making a straight cut through the heat shield 170 in the axial direction D1 when the heat shield 170 is installed in the gas turbine engine 100. Alternatively or in addition, a plane of the side-view cross section T may be any plane that includes the centerline X when the heat shield 170 is installed in the gas turbine engine 100. The side-view cross section T may be S-shaped, L-shaped, or any suitable shape such that the heat shield 170 may be positioned and maintained between the end 186 of the blade track 174 and the dip 172. Alternatively or in addition, the heat shield 170 may be any suitable shape such that, as a result of the heat shield 170 operating in the heat shield hot state and/or the nozzle guide vane 178 operating in the nozzle guide vane hot state, the edge 176 of the heat shield 170 contacts the nozzle guide vane 178, thus sealing the gap 180.

A conduit 222 may be defined by a space between the clip 172 and a portion of the nozzle guide vane 178. The conduit 222 may connect the cavity 182 and a recess 224. The conduit 222 may be a straight or curved passage. The recess 224 may be a space defined by the clip 172, the turbine casing 188, and a portion of the nozzle guide vane 178.

A W-seal 220 may be included in the recess 224. The W-seal 220 may be a structure that inhibits hot fluid from the fluid flow channel 184 from contacting the turbine casing 188. Hot fluid from the fluid flow channel 184 may unintentionally leak through the heat shield 170 or the nozzle guide vane 178 or otherwise travel through the heat shield 170 and nozzle guide vane 178 despite the heat shield 170 operating in the heat shield hot state, despite the nozzle guide vane 178 operating in the nozzle guide vane hot state, or despite both. The W-seal 220 may be a greater distance from the gap 180 than the heat shield's 170 distance from the gap 180. Alternatively or in addition, hot fluid from the fluid flow channel 184 may enter the recess 224 in response to the gap 180 being open.

For example, as a result of the gap 180 being open, fluid from the fluid flow channel 184 may travel from the fluid flow channel 184, radially outward through the gap 180 into the cavity 182. From the cavity 182, the fluid may travel through the conduit 222 into the recess 224. The W-seal 220 may, for example, inhibit fluid that has reached the recess 224 from contacting the turbine casing 188.

Figure 3:
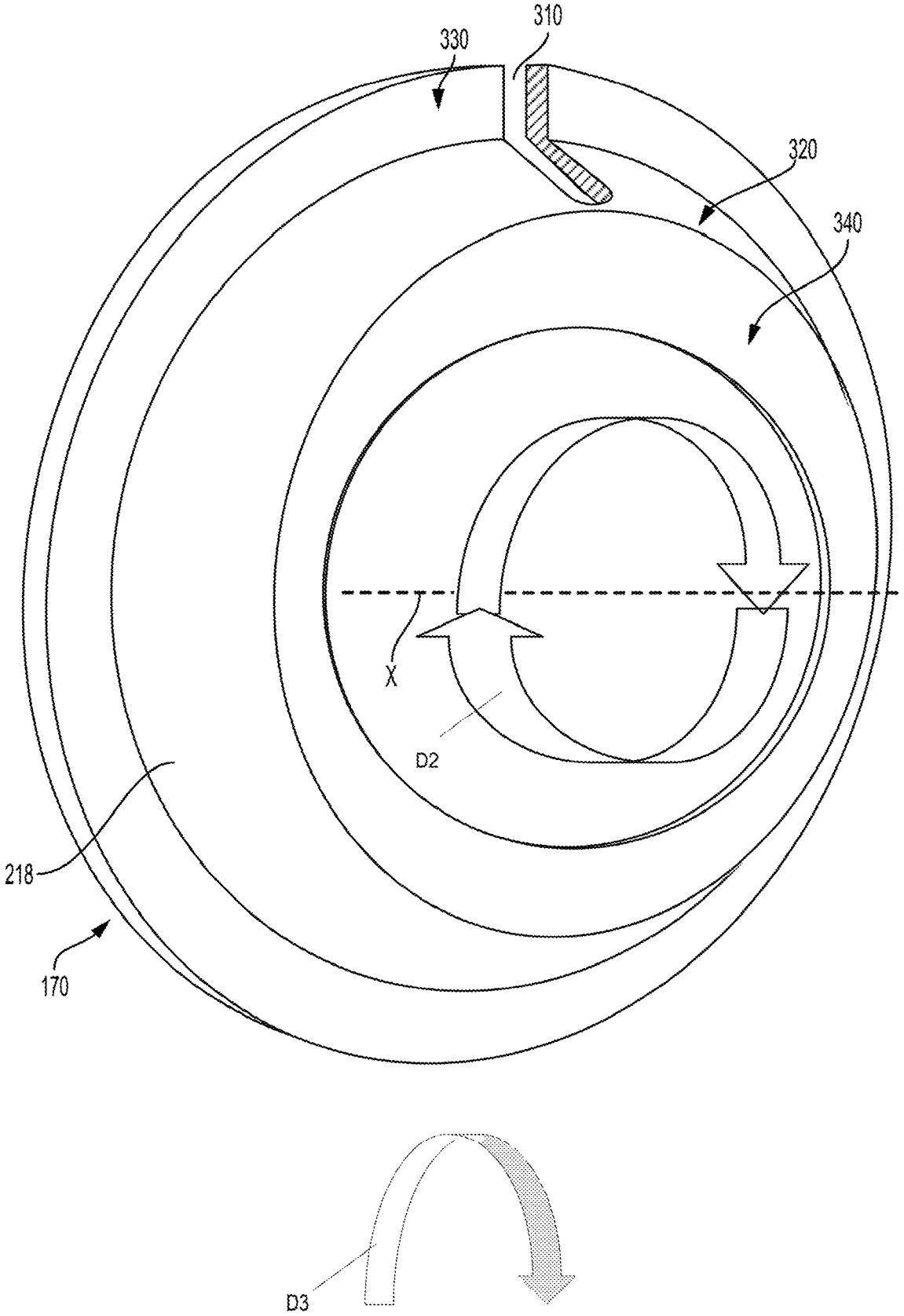
FIG. 3 illustrates an example of a heat shield.

FIG. 3 shows an example of the heat shield 170. The heat shield 170 shown in FIG. 3 includes the heat shield slot 310. As mentioned above, the heat shield 170 may include the heat shield slot 310. The heat shield slot 310 may be an opening sized to receive the anti-rotation pin 210. The heat shield 170 may be inhibited from rotating in the first rotational direction D2 as a result of the anti-rotation pin 210 having been received in the heat shield slot 310. Alternatively or in addition, the heat shield 170 may be inhibited from rotating in the first rotational direction D2 as a result of the anti-rotation pin 210 applying pressure onto the surface 218 of the heat shield 170. Examples of the heat shield slot 310 may include an indentation or an opening sized to receive the anti-rotation pin 210. In the example shown in FIG. 3, the heat shield 170 includes the single heat shield slot 310. In some examples, the heat shield may include multiple heat shield slots.

The heat shield 170 may include an upper lip 330, a middle portion 320, and a lower lip 340. The upper lip 330 may be a portion of the heat shield 170 that extends at an angle from the surface 218 of the heat shield 170. The upper lip 330 may contact the clip 172 as a result of the heat shield 170 positioned between the end 186 of the blade track 174 and the clip 172.

The middle portion 320 may include the surface 218. The middle portion may be the portion of the heat shield 170 that connects the upper lip 330 and the lower lip 340. The middle portion may be parallel with a plane A. Alternatively, the middle portion 320 may be non-planar.

The lower lip 340 may be a portion of the heat shield 170 that extends at an angle from the surface 218 of the heat shield 170. The lower lip may contact the end 186 of the blade track 174 in response to the heat shield positioned between the clip 172 and the end 186 of the blade track 174. Alternatively or in addition, the lower lip 340 may include the edge 186 of the heat shield 170. As mentioned above, the edge 186 of the heat shield 170 may contact the nozzle guide vane 178 as a result of the gap 180 being sealed, as a result of the nozzle guide vane 178 operating in the nozzle guide vane hot state, or as a result of the heat shield 170 operating in the heat shield hot state.

The upper lip 330, the middle portion 320, and the lower lip 340 may all be annularly shaped around the centerline X. Alternatively or in addition, in some examples, the heat shield 170 may have an annular cross section in a plane perpendicular to the centerline X. The upper lip 330, the middle portion 320, and the lower lip 340 may be independently shaped. The upper lip 330, the middle portion 320, and the lower lip 340 may each be annular, rectangular, or any suitable shape such that the heat shield 170 may be positioned and maintained between the end 186 of the blade track 174 and the clip 172.

Figure 4:
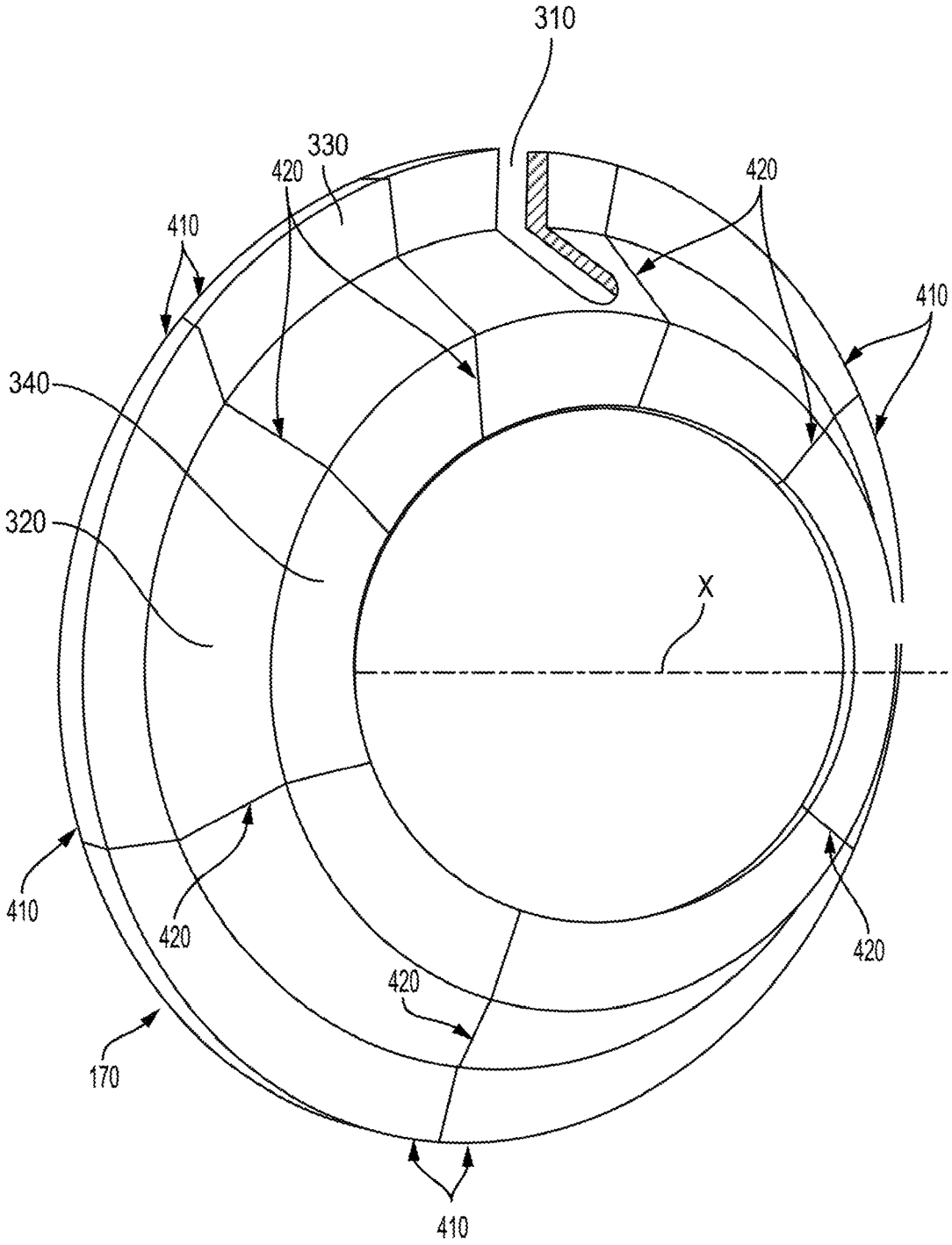
FIG. 4 illustrates an example of the heat shield formed from combination of heat shield sections.

FIG. 4 shows an example of the heat shield 170. The heat shield 170 shown in FIG. 4 includes a plurality of sections 410 of the heat shield 170 coupled together, for example by brazing or welding. The sections 410 may be fixedly or removably coupled together. Alternatively or in addition, the coupling of the sections 410 may occur at a plurality of interfaces 420. The interfaces 420 may be the portions of sections 410 that contact adjacent sections 410. The sections 410 may include the heat shield slot 310. The sections 410 may be combined to form the heat shield 170 such that the heat shield 170 fits between the clip 172 and the end 186 of the blade track 174.

Figure 5:
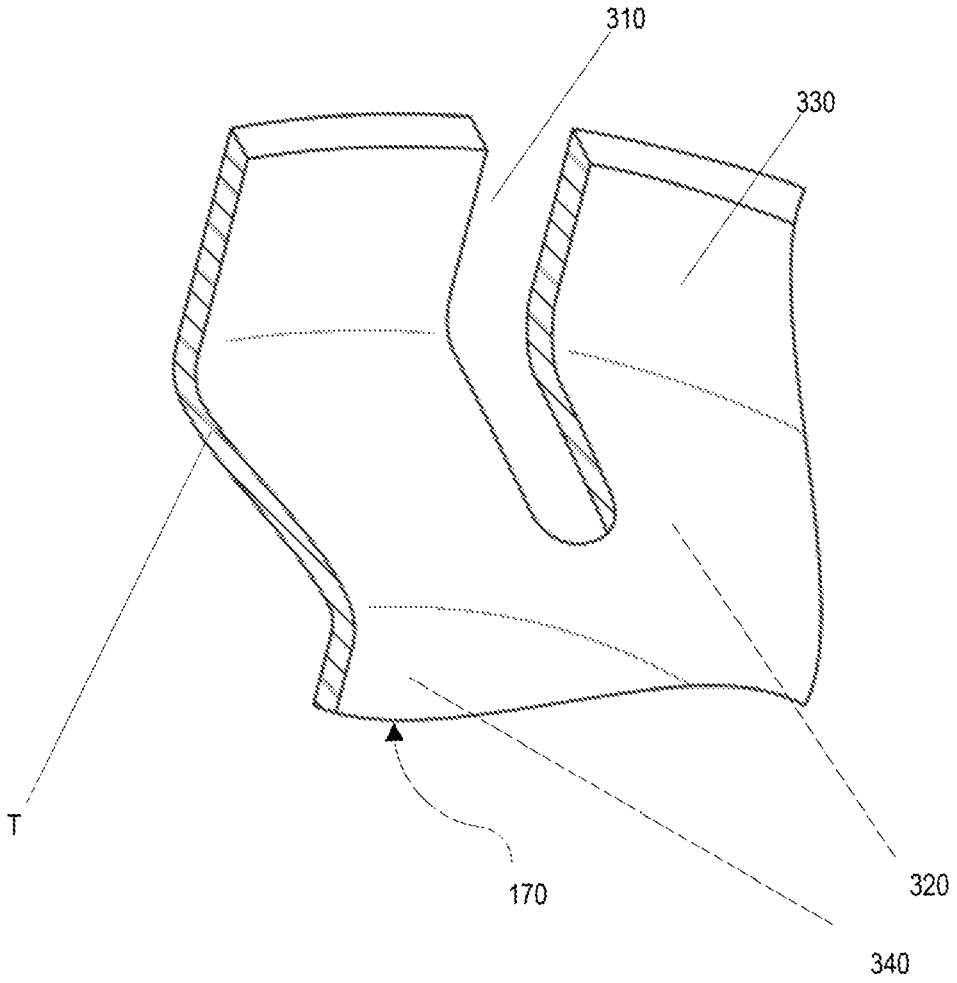
FIG. 5 illustration a section of the heat shield having an S-shaped cross section.

FIG. 5 shows an example of a portion of the heat shield 170. The portion of the heat shield 170 shown in FIG. 5 shows the side-view cross section T of the heat shield 170 formed in an S-shape. The side-view cross section T may be the cross section of the heat shield 170 that is formed by a combination of cross sections of the upper lip 330, the middle portion 320 and the lower lip 340. The side-view cross section T of the heat shield 170 may be any suitable shape such that the heat shield 170 may fit between the clip 172 and the end 186 of the blade track 174.

Figure 6:
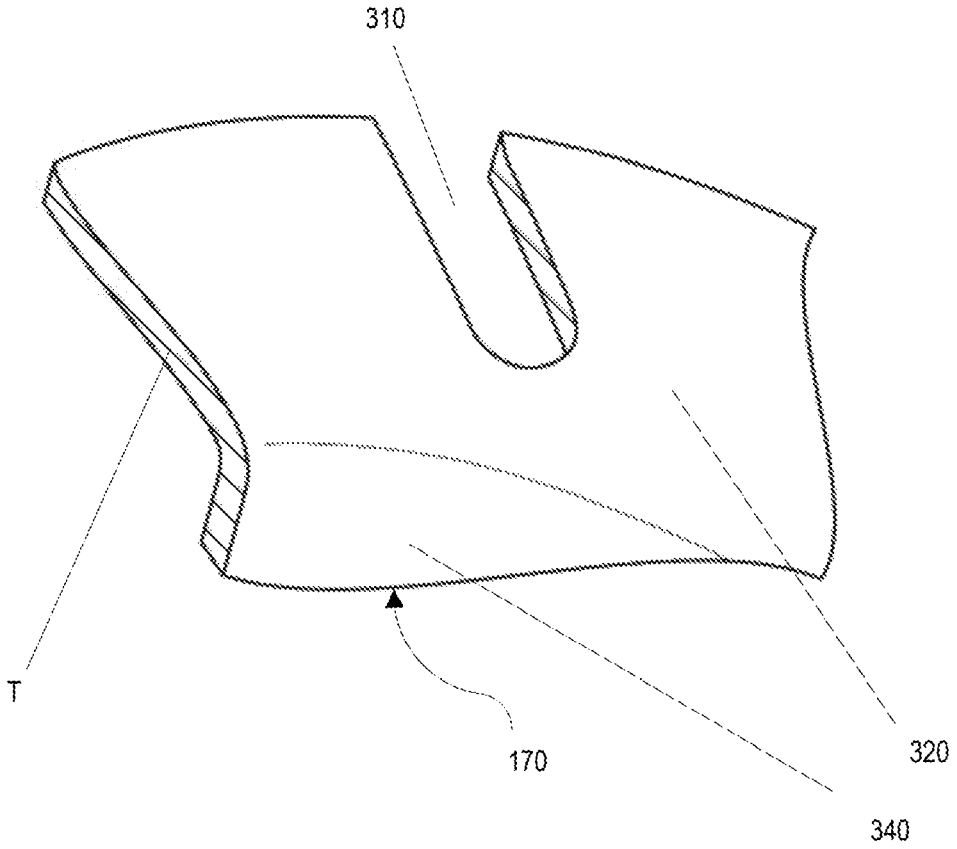
FIG. 6 illustration a section of the heat shield having an L-shaped cross section.

FIG. 6 shows an example of a portion of another example of the heat shield 170. The portion of the heat shield 170 shown in FIG. 6 shows the side-view cross section T of the heat shield 170 formed in an L-shape. Alternatively, in some examples, the side-view cross section T may be formed in a J-shape. In some examples, the side view cross section T of the heat shield 170 includes the combination of cross sections of the lower lip 340 and the middle portion 320.

Figure 7:
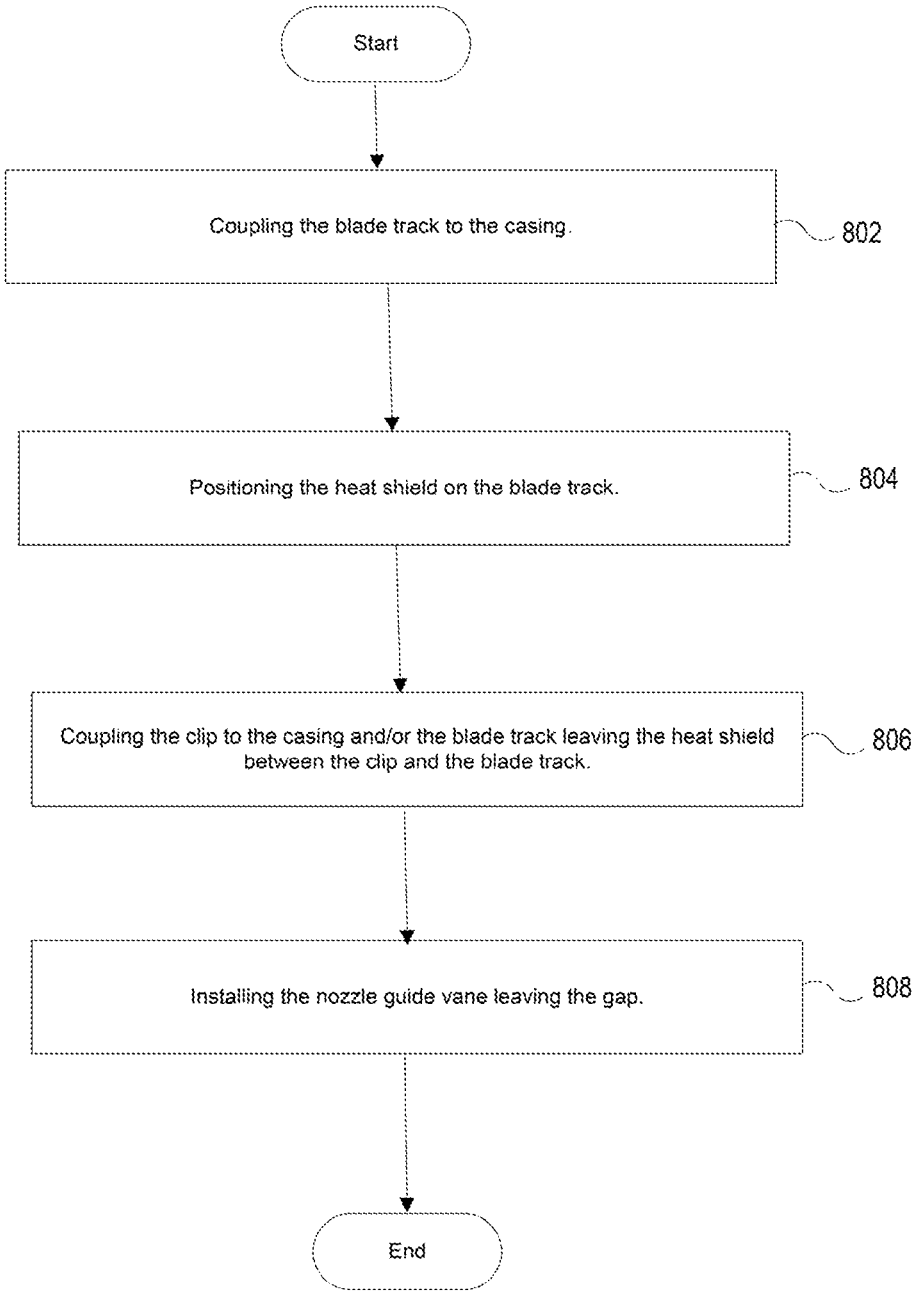
FIG. 7 illustrates a flow diagram of a method for assembling an apparatus that reduces a turbine casing's exposure to heat.

FIG. 7 shows a flowchart for a method of assembling cooling components of the gas turbine engine 100. The method may include coupling (802) the blade track 174 to the casing 188. In some examples the coupling (802) of the blade track 174 to the casing 188 includes inserting the anti-rotation pin 210 to assist in coupling the blade track 174 and the casing 188. Alternatively or in addition, the method may include positioning (804) the heat shield 170 on the blade track 174. In some examples, the heat shield 170 may be positioned to encounter the anti-rotation pin 210 and the anti-rotation pin 210 may be inserted into the heat shield slot 310. Alternatively or in addition, the method may include coupling (806) the clip 172 to the blade track 174. Alternatively or in addition, the clip 172 may be coupled to the casing 188. The clip 172 may be positioned such that the heat shield 170 is between the clip 172 and the blade track 174. Alternatively or in addition, the method may include installing (808) the nozzle guide vane 174 leaving the gap 180. The gap 180 may be defined by the edge 176 of the heat shield 170 and the nozzle guide vane 178. Alternatively or in addition, the edge 176 of the heat shield 170 would form a seal and close the gap 180 in response to a thermal expansion of the heat shield 170 and the thermal expansion of the nozzle guide vane 178. The gap 180 being sealed may inhibit hot fluid from contacting the casing 188. In some examples, the clip 172 may hold the heat shield 170 in place. The positioning of the heat shield 170 may be such that the gap 180 is sealed as a result of the heat shield operating in the heat shield hot state, the nozzle guide vane 178 operating in the nozzle guide vane 178 hot state, or a combination thereof. Alternatively or in addition, the gap 180 being sealed may prevent fluid, for example from the fluid flow channel 184 from entering the cavity 182 and contacting the turbine casing 188 or otherwise contacting the turbine casing 188.

Alternatively or in addition, the method may include welding, brazing, or some combination thereof, the heat shield 170 to the blade track 174. The welding, brazing or combination thereof may occur before or after the other steps of assembly of the cooling components, or even pre-assembled. Alternatively or in addition, the method may include welding, brazing, some combination thereof, the heat shield 170 to the end 186 of the blade track 174. Alternatively or in addition, the method may include inserting the anti-rotation pin 210 into the heat shield slot 310. Alternatively or in addition, the method may include applying pressure with the anti-rotation pin 310 onto the surface 218 of the heat shield 170. Alternatively or in addition, the method may include coupling the clip 172 to the turbine casing 188 by the hook 290. Alternatively or in addition, the method may include assembling the heat shield from the plurality of sections 410.

To clarify the use of and to hereby provide notice to the public, the phrases "at least one of <A>, <B>, . . . and <N>" or "at least one of <A>, <B>, . . . <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed.

While various embodiments have been described, it will be apparent to those of ordinary skill in the art that many more embodiments and implementations are possible. Accordingly, the embodiments described herein are examples, not the only possible embodiments and implementations.

The subject-matter of the disclosure may also relate, among others, to the following aspects:

1. A system comprising:
   a turbine casing;
   a blade track coupled to the turbine casing with a clip;
   a nozzle guide vane coupled to the turbine casing, wherein an end of the blade track, the clip, and a portion of the nozzle guide vane form a cavity; and
   a heat shield positioned between the clip and the end of the blade track in the cavity, an edge of the heat shield and the portion of the nozzle guide vane form a gap, the heat shield and the nozzle guide vane configured to close the gap in response to a thermal expansion of the heat shield and a thermal expansion of the nozzle guide vane.
2. The system of aspect 1, wherein the heat shield is inhibited from rotating in a first rotational direction by an anti-rotation pin, the first rotational direction being a direction of rotation of a turbine blade assembly housed within the turbine casing, and the heat shield is inhibited from rotating in a second rotational direction by the clip, the second rotational direction orthogonal to the first rotational direction.
3. The system of any of aspects 1 to 2, wherein the heat shield comprises a slot to receive an anti-rotation pin.
4. The system of any of aspects 1 to 3, wherein the clip is coupled to the anti-rotation pin at a first end of the clip and at a second end of the clip, the first end of the clip opposite the second end of the clip.
5. The system of any of aspects 1 to 4, wherein the heat shield comprises a plurality of segments fixedly coupled together.
6. The system of any of aspects 1 to 5, wherein the clip has a C-shape.
7. The system of any of aspects 1 to 6, wherein the heat shield has a cross section defined by an intersection of the heat shield and a plane including the axis of rotation of a turbine blade assembly, the turbine blade assembly housed in the turbine casing, and the cross section having an S-shape.
8. The system of any of aspects 1 to 7, wherein the heat shield has a cross section defined by an intersection of the heat shield and a plane including the axis of rotation of a turbine blade assembly, the turbine blade assembly housed in the turbine casing, and the cross section having an L-shape.
9. The system of any of aspects 1 to 8, wherein the heat shield has wherein the heat shield has a cross section, the cross section defined by a plane perpendicular to the axis of rotation of a turbine blade assembly, the turbine blade assembly housed in the turbine casing, the cross section having an annular shape.
10. The system of any of aspects 1 to 9, wherein the heat shield comprises a nickel-based alloy.
11. The system of any of aspects 1 to 10, wherein the heat shield is welded to the blade track.
12. The system of any of aspects 1 to 11, wherein the heat shield is brazed to the blade track.
13. The system of any of aspects 1 to 12 further comprising a W-seal, the W-seal positioned a first distance radially outward from an axis of rotation of a turbine blade assembly and the heat shield positioned a second distance radially outward from the axis of rotation of the turbine blade assembly the first distance being greater than the second distance.
14. A method comprising:
   coupling a blade track to a turbine casing;
   positioning a heat shield on the blade track;
   coupling a clip and the blade track, the heat shield positioned between the clip and the blade track; and
   installing a nozzle guide vane leaving a gap defined by an edge of the heat shield and the nozzle guide vane, the edge and the nozzle guide vane would form a seal and close the gap in response to a thermal expansion of the heat shield and a thermal expansion of the nozzle guide vane, the seal configured to prevent a fluid flow through the gap to the turbine casing.
15. The method of aspect 14 further comprising welding the heat shield to the blade track.
16. The method of any of aspects 14 to 15 further comprising inserting an anti-rotation pin into a slot of the heat shield, the slot configured to receive the anti-rotation pin.
17. The method of any of aspects 14 to 16 further comprising coupling an anti-rotation pin onto a surface of the heat shield.
18. The method of aspects 14 to 17 further comprising assembling a plurality of shield segments to form the heat shield.
19. The method of aspects 14 to 18, wherein the clip includes a hook, and coupling the clip and the turbine casing is in response to the hook coupling with the turbine casing.
20. A system comprising:
   a turbine casing;
   a blade track coupled to the turbine casing with a C-shaped clip;
   a nozzle guide vane coupled to the turbine casing, wherein an end of the blade track, the C-shaped clip, and the nozzle guide vane form a cavity;
   a heat shield located in the cavity, the heat shield in a shape of an "S", the heat shield having a first edge on one end of the "S" and a second edge on the other end of the "S", the first edge of the heat shield located between the C-shaped clip and the end of the blade track, the second edge of the heat shield and the nozzle guide vane form a gap, the heat shield and the nozzle guide vane configured to close the gap in response to a thermal expansion of the heat shield and a thermal expansion of the nozzle guide vane;
   a pin configured to inhibit the heat shield from rotating in a first rotational direction, the heat shield comprising a slot configured to receive the pin, the pin positioned in the slot; and
   the C-shaped clip configured to inhibit the S-shaped heat shield from rotating in a second rotational direction that is orthogonal to the first rotational direction.

What is claimed is:

1. A system comprising:
   a turbine casing;
   a blade track coupled to the turbine casing with a clip;

a nozzle guide vane coupled to the turbine casing, wherein an end of the blade track, the clip, and a portion of the nozzle guide vane form a cavity; and a heat shield positioned between the clip and the end of the blade track in the cavity, an edge of the heat shield and the portion of the nozzle guide vane form a gap in a cold state, the heat shield and the nozzle guide vane configured to close the gap in response to a thermal expansion of the heat shield and a thermal expansion of the nozzle guide vane in a state of operation, wherein the heat shield comprises a slot to receive an anti-rotation pin.

2. The system of claim 1, wherein the heat shield is inhibited from rotating in a first rotational direction by the anti-rotation pin, the first rotational direction being a direction of rotation of a turbine blade assembly housed within the turbine casing, and the heat shield is inhibited from rotating in a second rotational direction by the clip, the second rotational direction orthogonal to the first rotational direction.

3. The system of claim 1, wherein the clip is coupled to the anti-rotation pin at a first end of the clip and at a second end of the clip, the first end of the clip opposite the second end of the clip.

4. The system of claim 1, wherein the heat shield comprises a plurality of segments fixedly coupled together.

5. The system of claim 1, wherein the clip has a C-shape.

6. The system of claim 1, wherein the heat shield has a cross section defined by an intersection of the heat shield and a plane including the axis of rotation of a turbine blade assembly, the turbine blade assembly housed in the turbine casing, and the cross section having an S-shape.

7. The system of claim 1, wherein the heat shield has a cross section defined by an intersection of the heat shield and a plane including the axis of rotation of a turbine blade assembly, the turbine blade assembly housed in the turbine casing, and the cross section having an L-shape.

8. The system of claim 1, wherein the heat shield has wherein the heat shield has a cross section, the cross section defined by a plane perpendicular to the axis of rotation of a turbine blade assembly, the turbine blade assembly housed in the turbine casing, the cross section having an annular shape.

9. The system of claim 1, wherein the heat shield comprises a nickel-based alloy.

10. The system of claim 1, wherein the heat shield is welded to the blade track.

11. The system of claim 1, wherein the heat shield is brazed to the blade track.

12. The system of claim 1 further comprising a W-seal, the W-seal positioned a first distance radially outward from an axis of rotation of a turbine blade assembly and the heat shield positioned a second distance radially outward from the axis of rotation of the turbine blade assembly the first distance being greater than the second distance.

13. A method comprising:

coupling a blade track to a turbine casing;

positioning a heat shield on the blade track;

coupling a clip and the blade track, the heat shield positioned between the clip and the blade track;

installing a nozzle guide vane leaving a gap defined by an edge of the heat shield and the nozzle guide vane in a cold state, the edge and the nozzle guide vane would form a seal and close the gap in response to a thermal expansion of the heat shield and a thermal expansion of the nozzle guide vane in a state of operation, the seal configured to prevent a fluid flow through the gap to the turbine casing; and inserting an anti-rotation pin into a slot of the heat shield, the slot configured to receive the anti-rotation pin.

14. The method of claim 13 further comprising welding the heat shield to the blade track.

15. The method of claim 13 further comprising maintaining a position of the heat shield by the anti-rotation pin applying pressure onto a surface of the heat shield.

16. The method of claim 13 further comprising assembling a plurality of shield segments to form the heat shield.

17. The method of claim 13, wherein the clip includes a hook, and coupling the clip and the turbine casing is in response to the hook coupling with the turbine casing.

18. A system comprising:

a turbine casing;

a blade track coupled to the turbine casing with a C-shaped clip;

a nozzle guide vane coupled to the turbine casing, wherein an end of the blade track, the C-shaped clip, and the nozzle guide vane form a cavity;

a heat shield located in the cavity, the heat shield in a shape of an "5", the heat shield having a first edge on one end of the "5" and a second edge on the other end of the "5", the first edge of the heat shield located between the C-shaped clip and the end of the blade track, the second edge of the heat shield and the nozzle guide vane form a gap in a cold state, the heat shield and the nozzle guide vane configured to close the gap in response to a thermal expansion of the heat shield and a thermal expansion of the nozzle guide vane in a state of operation;

a pin configured to inhibit the heat shield from rotating in a first rotational direction, the heat shield comprising a slot configured to receive the pin, the pin positioned in the slot; and the C-shaped clip configured to inhibit the S-shaped heat shield from rotating in a second rotational direction that is orthogonal to the first rotational direction.

* * * * *